US011318056B2

(12) United States Patent
Malings

(10) Patent No.: US 11,318,056 B2
(45) Date of Patent: May 3, 2022

(54) WHEELCHAIR INJURY-PREVENTION DEVICE AND METHOD OF USE

(71) Applicant: Clifford L. Malings, Valparaiso, IN (US)

(72) Inventor: Clifford L. Malings, Valparaiso, IN (US)

( * ) Notice: Subject to any disclaimer, the term of this patent is extended or adjusted under 35 U.S.C. 154(b) by 459 days.

(21) Appl. No.: 16/555,614

(22) Filed: Aug. 29, 2019

(65) Prior Publication Data

US 2020/0069488 A1 Mar. 5, 2020

Related U.S. Application Data

(60) Provisional application No. 62/724,957, filed on Aug. 30, 2018.

(51) Int. Cl.
*A61G 5/10* (2006.01)
*A61G 5/12* (2006.01)

(52) U.S. Cl.
CPC ..... *A61G 5/1043* (2013.01); *A61G 5/128* (2016.11)

(58) Field of Classification Search
CPC ..... A61G 5/1043; A61G 5/128
See application file for complete search history.

(56) References Cited

U.S. PATENT DOCUMENTS

| | | | | |
|---|---|---|---|---|
| 6,938,912 | B1 * | 9/2005 | Norton | B60D 1/06 280/507 |
| 8,122,925 | B2 | 2/2012 | Lane et al. | |
| 9,132,050 | B1 | 9/2015 | Hector, Jr. | |
| 9,980,864 | B2 | 5/2018 | Thomas | |
| 10,016,323 | B2 | 7/2018 | Hall et al. | |
| 10,456,308 | B2 * | 10/2019 | Ditor | A61G 5/128 |
| 10,596,049 | B2 * | 3/2020 | Smith | A61G 5/10 |
| 2013/0112827 | A1 * | 5/2013 | Holstad | A61G 5/10 248/229.2 |

* cited by examiner

*Primary Examiner* — Kevin Hurley
*Assistant Examiner* — Harold Eric Pahlck, III
(74) *Attorney, Agent, or Firm* — Brannon Sowers & Cracraft PC

(57) ABSTRACT

A resiliently-deformable unitary polymer body configured to be removably installed on a wheelchair footrest bracket may comprise first and second keyhole-shaped openings on a first side of the body for snapping-on to the wheelchair frame tube and the pivot pin or post on the footrest bracket, respectively. Additionally, a planar cavity may be located in the body, intersecting perpendicularly the first and second keyhole-shaped openings, and open at least in part to the first side, for receiving at least partially therein a planar blade portion of the footrest bracket. Opposite the first side, cushioned second and front sides of the body are designed to be positioned toward the front of the wheelchair to protect a user's legs. The body may be symmetrical about a horizontal plane so that it can be flipped over and used on both left and right sides of a wheelchair. Methods of use are provided.

20 Claims, 7 Drawing Sheets

WHEELCHAIR INJURY-PREVENTION DEVICE AND METHOD OF USE

CROSS-REFERENCE TO RELATED APPLICATIONS

This application claim priority to, incorporates herein by reference, and is a non-provisional of U.S. Provisional Patent Application Ser. No. 62/724,957 to Malings, entitled Wheelchair Injury-Prevention Device and Method of Use, filed Aug. 30, 2018.

FEDERALLY SPONSORED RESEARCH OR DEVELOPMENT

None.

TECHNICAL FIELD

The present invention relates to the field of wheelchairs, and in particular, to a safety device configured for use with wheelchairs that helps guard against injury from footrest attachment areas on wheelchairs.

BACKGROUND

With reference to FIGS. 1 and 2, blade-like brackets 100 are exposed on conventional wheelchairs 10 when footrest brackets 20 are removed from the wheelchair 10. These blade-like brackets 100 are positioned proximate the legs of a person sitting in the wheelchair, and have for decades inflicted bruises, cuts, and misery on wheelchair users. The problem is especially pronounced with users more susceptible to these types of injuries, such as the elderly, diabetes patients, and those cognitively unaware of being injured. These wheelchair-created afflictions can cause discomfort, infections, blood clots, or even amputations.

Various attempts have been made to deal with this problem. The following United States patents and published United States patent applications are incorporated herein by reference in their entireties as if fully reproduced herein: U.S. Pat. No. 10,016,323 B2 to Hall et al. entitled Wheelchair Injury-Prevention Guard and issued Jul. 10, 2018 (Hall et al.); U.S. Pat. No. 9,980,864 B2 to Thomas entitled Calf Bumper System and issued May 29, 2018; U.S. Pat. No. 9,132,050 B1 to Hector, J R. entitled Protective Cushion for a Wheelchair Foot Rest and Method of Providing and issued Sep. 15, 2015 (Hector, J R.); and U.S. Pat. No. 8,122,925 B2 to Lane et al. entitled Protective Cover Device for Attachment Over Foot Rest Brackets on a Wheelchair and issued Feb. 28, 2012 (Lane et al.).

While various attempts have been made to guard against injury from footrest attachment areas on wheelchairs, each of the above proposed solutions presents its own drawbacks and limitations, including cost, weight, complexity, difficulty of use, and lack of robustness and durability, for example. By way of example, known solutions would either be relatively expensive to manufacture, or would provide insufficient protection for a wheelchair user, or would tend to be difficult to install, or would tend to fall off once installed, or various combinations of the foregoing. Accordingly, a need exists for an improved, simple, robust, durable, easy-to-use safety device that helps guard against injury from footrest attachment areas on wheelchairs.

SUMMARY

The present invention elegantly addresses all the above challenges and provides numerous additional benefits as will be appreciated by persons of skill in the art upon reviewing this disclosure. Provided in various example embodiments is a resiliently-deformable unitary polymer body configured to be removably installed on a wheelchair footrest bracket, the body comprising: top and bottom sides separated by a height; front and back sides separated by a depth; first and second sides separated by a width; a first keyhole-shaped opening comprising a first wall defining a first cylindrical portion having a first diameter and extending from the top side to the bottom side and open to the top side and the bottom side, the first wall also extending to the first side and forming a first slot extending from the top side to the bottom side and defining a first opening from the first side into the first cylindrical portion, the first opening configured to have an undeformed first width less than the first diameter, and configured to be deformable to have a deformed first width at least equal to the first diameter; a second keyhole-shaped opening spaced-apart from the first keyhole-shaped opening and comprising a second wall defining a second cylindrical portion having a second diameter and extending from the top side to the bottom side and open to the top side and the bottom side, the second wall also extending to the first side and forming a second slot extending from the top side to the bottom side and defining a second opening from the first side into the second cylindrical portion, the second opening configured to have an undeformed second width less than the second diameter, and configured to be deformable to have a deformed second width at least equal to the second diameter; and a planar cavity located between the top and bottom sides, the planar cavity intersecting perpendicularly the first and second keyhole-shaped openings, and open at least in part to the first side.

In various example embodiments the resiliently-deformable unitary polymer body may further comprise the first diameter being at least twice as large as the second diameter. The resiliently-deformable unitary polymer body may further comprise the planar cavity being positioned mid-way between the top and bottom sides. The resiliently-deformable unitary polymer body may further comprise the first cylindrical portion being sized, shaped, and positioned within the resiliently-deformable unitary polymer body to at least substantially encompass and resiliently urge against a wheelchair frame tube on which a wheelchair footrest bracket is mounted, when the resiliently-deformable unitary polymer body is installed on the wheelchair footrest bracket. The resiliently-deformable unitary polymer body may further comprise the second cylindrical portion being sized, shaped, and positioned within the resiliently-deformable unitary polymer body to at least substantially encompass and resiliently urge against a post that extends upward from a planar blade of a wheelchair footrest bracket, when the resiliently-deformable unitary polymer body is installed on the wheelchair footrest bracket. The resiliently-deformable unitary polymer body may further comprise the planar cavity being sized, shaped, and positioned within the resiliently-deformable unitary polymer body to at least partially encompass and resiliently urge against a planar blade of a wheelchair footrest bracket, when the resiliently-deformable unitary polymer body is installed on the wheelchair footrest bracket. One or more (or all) of the above features may be included on resiliently-deformable unitary polymer body in various example embodiments.

Also provided in various example embodiments is a wheelchair, comprising: a frame tube; a footrest bracket mounted to the frame tube, the footrest bracket comprising: a planar blade extending perpendicularly from the frame tube; a post that extends upward from the planar blade; and a resiliently-deformable unitary polymer body as described herein, mounted to the footrest bracket. The wheelchair may further comprise the resiliently-deformable unitary polymer body being mounted to the footrest bracket so that the first cylindrical portion at least substantially encompasses and resiliently urges against the wheelchair frame tube. The wheelchair may further comprise the resiliently-deformable unitary polymer body being mounted to the footrest bracket so that the second cylindrical portion at least substantially encompasses and resiliently urges against the post. The wheelchair may further comprise the resiliently-deformable unitary polymer body being mounted to the footrest bracket so that the planar cavity at least partially encompasses and resiliently urges against the planar blade. One or more (or all) of the above features may be included on a wheelchair in various example embodiments.

Further provided in various example embodiments is a method of removably installing a resiliently-deformable unitary polymer body on a wheelchair footrest bracket, comprising the steps of: providing a wheelchair, comprising: a frame tube having a frame tube diameter; a footrest bracket mounted to the frame tube, the footrest bracket comprising: a planar blade extending perpendicularly from the frame tube; a post that extends upward from the planar blade, the post having a post diameter; providing a resiliently-deformable unitary polymer body as described herein; and mounting the resiliently-deformable unitary polymer body on the footrest bracket.

In various example embodiments, the step of mounting the resiliently-deformable unitary polymer body on the footrest bracket may further comprise the steps of sliding the planar blade at least partially into planar cavity so that the planar cavity at least partially encompasses and resiliently urges against the planar blade. In various example embodiments, the step of mounting the resiliently-deformable unitary polymer body on the footrest bracket may further comprise the steps of mounting the first cylindrical portion of the resiliently-deformable unitary polymer body to the footrest bracket by urging the first slot against the wheelchair frame tube, temporarily deforming the first opening to have a width at least equal to the frame tube diameter, and moving the first cylindrical portion to be adjacent the wheelchair frame tube, so the first cylindrical portion at least substantially encompasses and resiliently urges against the wheelchair frame tube. In various example embodiments, the step of mounting the resiliently-deformable unitary polymer body on the footrest bracket may further comprise the steps of mounting the second cylindrical portion of the resiliently-deformable unitary polymer body to the footrest bracket by urging the second slot against the post, temporarily deforming the second opening to have a width at least equal to the post diameter, and moving the second cylindrical portion to be adjacent the post, so the second cylindrical portion at least substantially encompasses and resiliently urges against the post. One or more (or all) of the above steps may be included, in any suitable order, in various methods of use according to various example embodiments.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The accompanying figures, with dashed lines representing hidden lines in a given view, illustrate certain aspects of example embodiments of the invention.

FIB. 1B is a perspective view of a pair of conventional footrest brackets of a type with which the present wheelchair injury-prevention device and method may be used.

Figure 2:
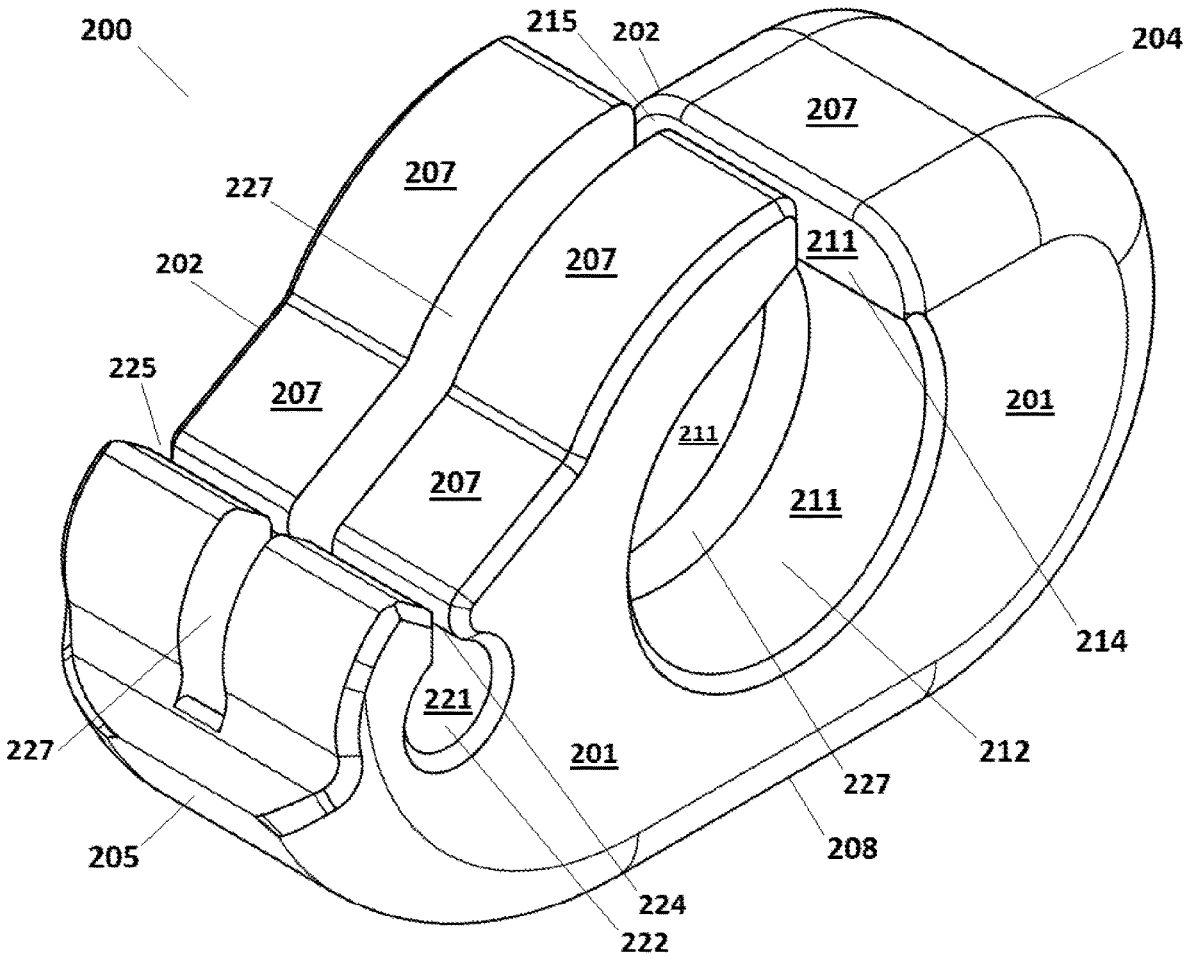

FIG. 2 is a top perspective view of an example wheelchair injury-prevention device according to various example embodiments.

Figure 3:
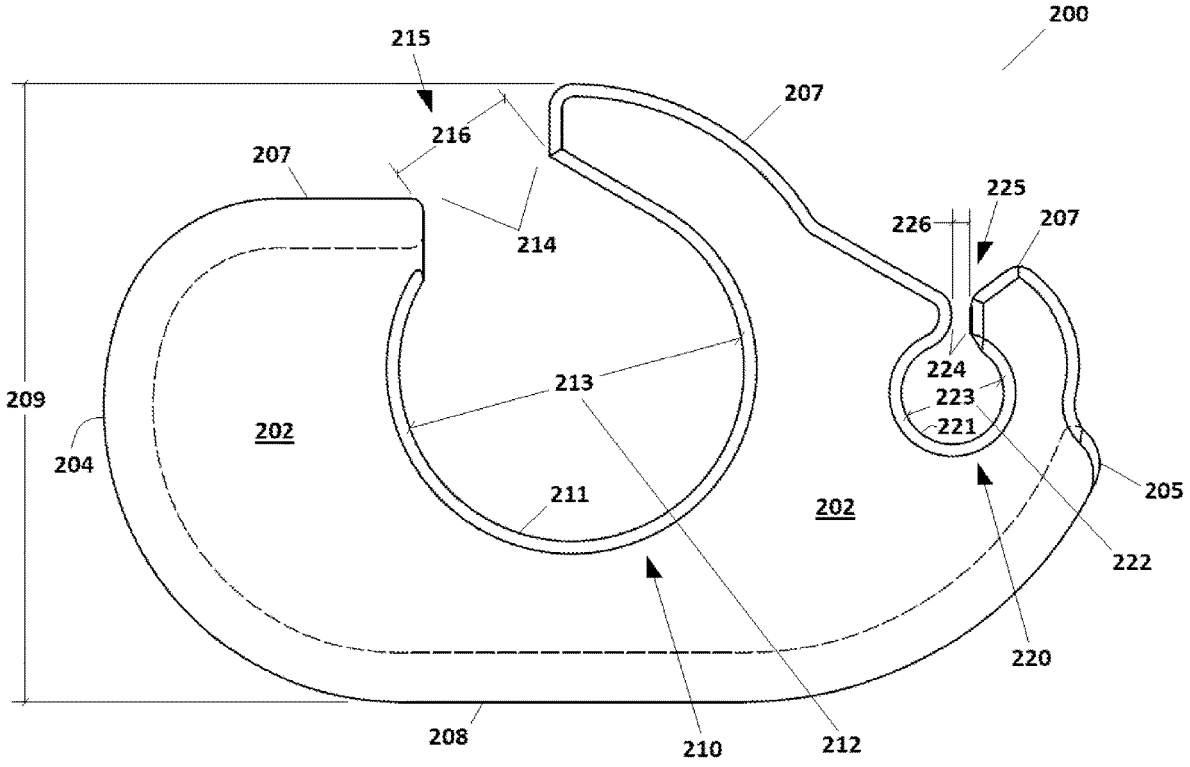

FIG. 3 is a bottom plan view of the example wheelchair injury-prevention device of FIG. 2, according to various example embodiments.

Figure 4:
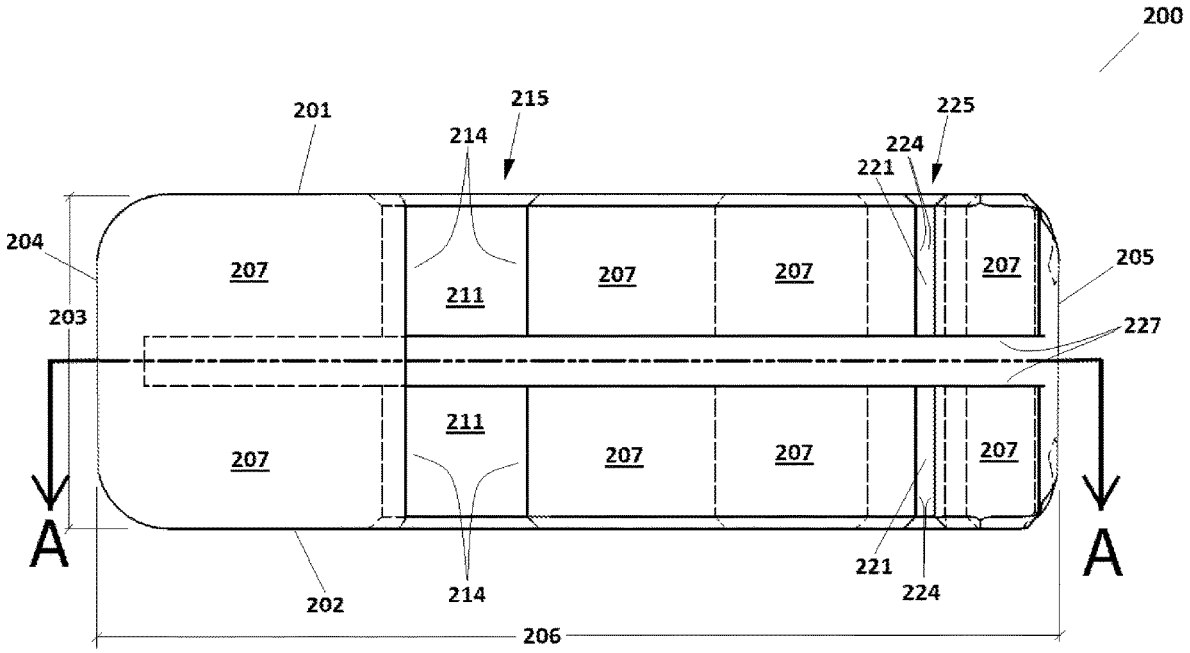

FIG. 4 is a first side elevation view of the example wheelchair injury-prevention device of FIG. 2, according to various example embodiments.

Figure 5:
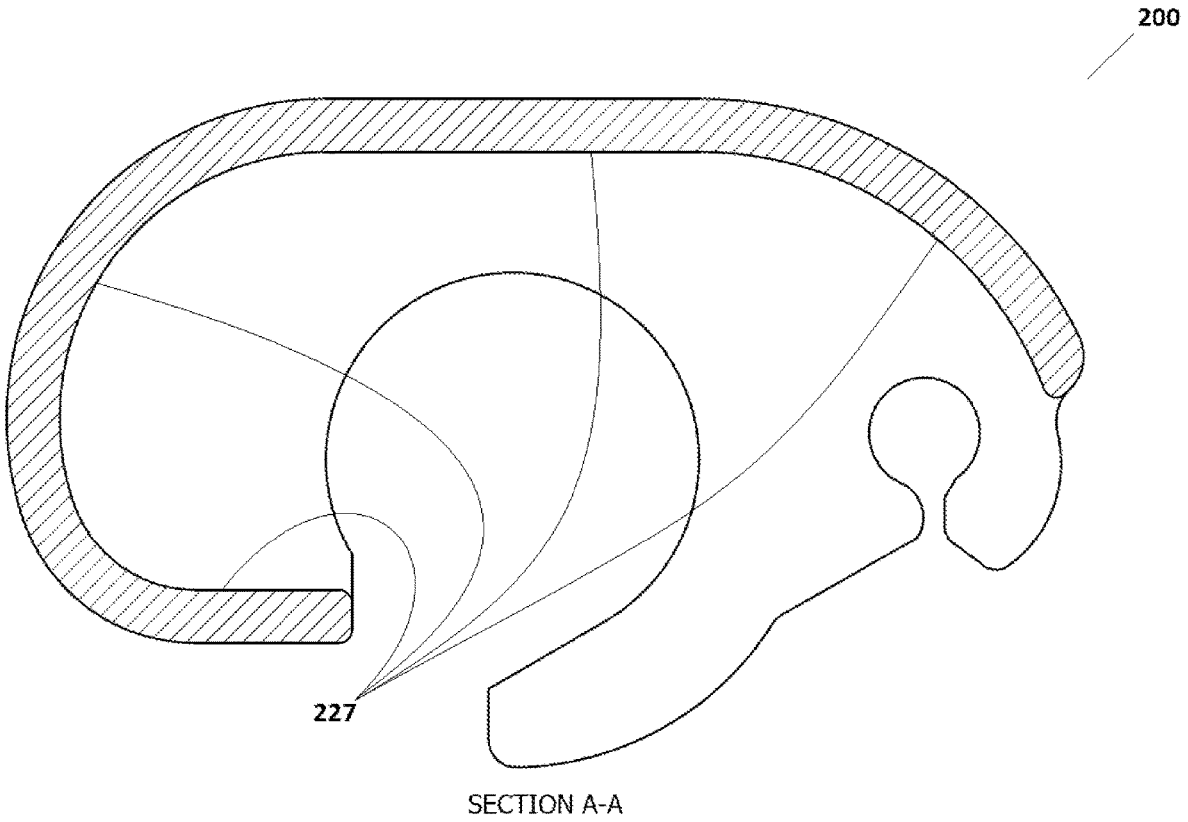

FIG. 5 is a section view of the example wheelchair injury-prevention device of FIG. 2 according to various example embodiments, taken along section line A-A of FIG. 4.

Figure 6:
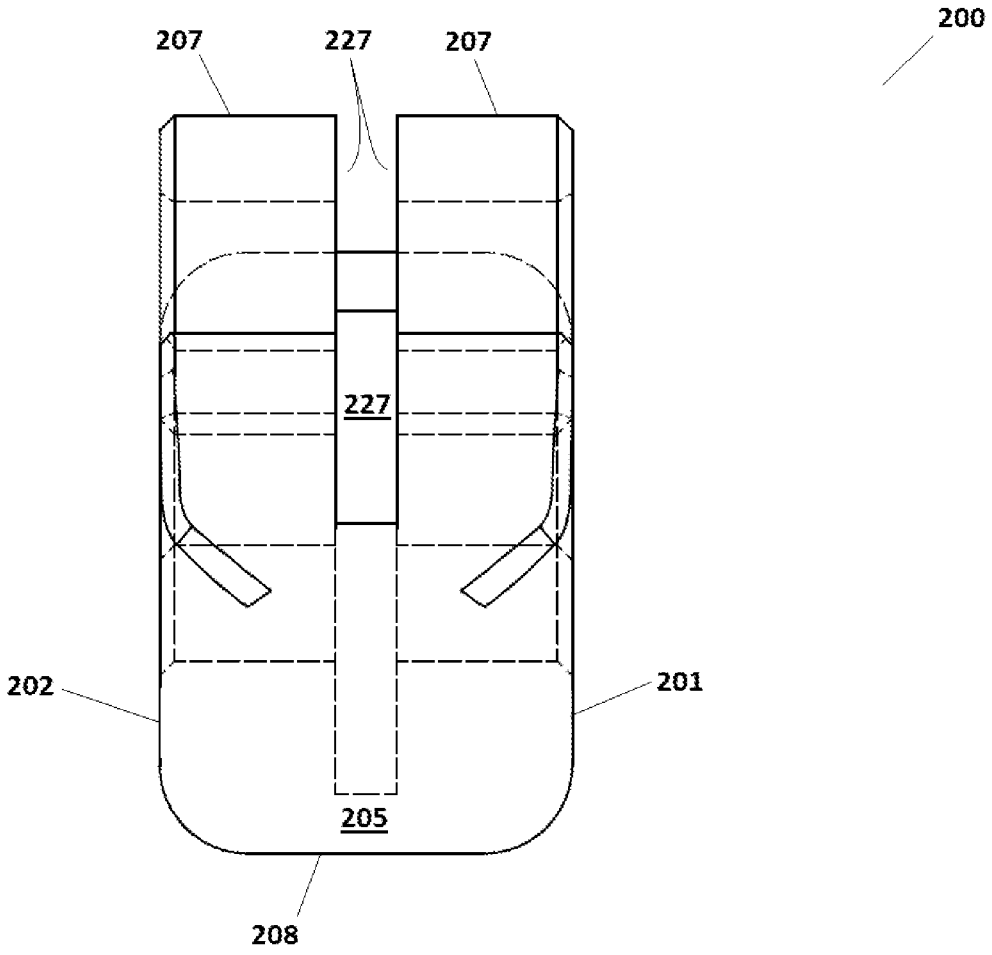

FIG. 6 is a back side elevation view of the example wheelchair injury-prevention device of FIG. 2, according to various example embodiments.

The same reference numerals refer to the same parts throughout the various Figures.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

With reference to FIGS. 1-6 and Hall et al., Hector, J R., and Lane et al., incorporated herein by reference, the present wheelchair injury-prevention device, sometimes referred to as a shield, is referred to as a resiliently-deformable unitary polymer body 200 configured to be removably installed on a bracket 100 for mounting a footrest 20 on a wheelchair 10. In various example embodiments, the present resiliently-deformable unitary polymer body 200 differs from existing designs in a variety of ways, including by making use of the pivot pin or post 104 on the footrest attachment bracket 102 attached to a frame tube 111 of a wheelchair 10. The resiliently-deformable unitary polymer body 200 may be configured in size, shape, and material to grip an outer diameter 105 of the pin 104 securely to ensure the resiliently-deformable unitary polymer body 200 does not fall off the bracket 100 when bumped, for instance during use of the wheelchair 10. Additionally, the resiliently-deformable unitary polymer body 200 may be configured in size, shape, and material to tightly grasp the outer diameter 112 of the wheelchair frame tube 111, tightly. Other devices have focused on encircling the entire footrest attachment bracket 100 with either multi-piece devices, and/or devices that are prone to come apart or otherwise readily detach from and fall off the wheelchair 10. Example devices according to the present invention need not (but optionally may) encircle the entire footrest attachment bracket 100; rather, the (front) portion of the bracket 100 proximate the leg of a user is covered by the present resiliently-deformable unitary polymer body 200.

In various example embodiments the portion of the resiliently-deformable unitary polymer body 200 positioned to be contacted by the leg of a user of the wheelchair 10 (see FIG. 1 of Hector, Jr.) may be sized and shaped to minimize impact force when a wheelchair user's leg strikes the resiliently-deformable unitary polymer body 200 when installed on a wheelchair 10. Instead of a narrow or small impact surface, the present device may employ larger impact surfaces, such as front side 204 and second side 208, with chamfered and/or large-radius-curved edges to minimize the contact pressure of an impact. The body 200 may be formed from any suitably soft yet resilient, strong, and durable material such as, for example, polyethylene or medical grade silicone. For example, body 200 may be cast in a soft platinum cured silicone, which has antimicrobial attributes that kill germs and is easily cleanable and sanitized. The present one-piece design may provide multiple attachment features sized and shaped to resiliently hold on to the wheelchair 10. For instance, the resiliently-deformable unitary polymer body 200 may be formed from a relatively soft and compliant material to provide a comfortable and safe cushion while remaining reliably attached to the wheelchair 10 during use, all while permitting easy removal and replacement of the devices onto and off of a wheelchair 10 by hand and without tools, by flexing the device 200 and essentially "snapping" it onto and around the wheelchair frame tube 111, pivot pin or post 104, and the planar blade 102 of a bracket 100 for mounting a footrest 20 on a wheelchair 10.

With continuing reference to FIGS. 1-6, provided in various example embodiments is a resiliently-deformable unitary polymer body 200 configured to be removably installed on a bracket 100 for mounting a footrest 20 on a wheelchair 10. In various example embodiments the body 200 may comprise a top side 201 and bottom side 202 separated by a height 203; a front side 204 and back side 205 separated by a depth 206; and a first side 207 and second side 208 separated by a width 209. To employ larger impact surfaces and lower impact pressures, the height 203 may be selected to be between five and ten times greater (or more) than the thickness of planar cavity 227, which may be sized to fit closely against the thin planar blade 102 of bracket 100. In various example embodiments height 203 may be selected to be at least one inch, for example.

In various example embodiments the body 200 may comprise a first keyhole-shaped opening 210 comprising a first wall 211 defining a first cylindrical portion 212 having a first diameter 213 and extending from the top side 201 to the bottom side 202 and open to the top side 201 and the bottom side 202, the first wall 211 also extending to the first side 207 and forming a first slot 214 extending from the top side 201 to the bottom side 202 and defining a first opening 215 from the first side 207 into the first cylindrical portion 212, the first opening 215 configured to have an undeformed first width 216 less than the first diameter 213, and configured to be deformable to have a deformed first width (not shown) at least equal to (and optionally more than) the first diameter 213. The term keyhole shape is meant to be interpreted broadly, with reference to the present figures and other known shapes identified as keyhole shapes.

In various example embodiments the body 200 may comprise a second keyhole-shaped opening 220 spaced-apart from the first keyhole-shaped opening 210 and comprising a second wall 221 defining a second cylindrical portion 222 having a second diameter 223 and extending from the top side 201 to the bottom side 202 and open to the top side 201 and the bottom side 202, the second wall 221 also extending to the first side 207 and forming a second slot 224 extending from the top side 201 to the bottom side 202 and defining a second opening 225 from the first side 207 into the second cylindrical portion 222, the second opening 225 configured to have an undeformed second width 226 less than the second diameter 223, and configured to be deformable to have a deformed second width (not shown) at least equal to (and optionally more than) the second diameter 223.

In various example embodiments the body 200 may comprise a planar cavity 227 located between the top and bottom sides, 201, 202, respectfully, the planar cavity 227 intersecting perpendicularly the first and second keyhole-shaped openings, 210, 220, respectively, and open at least in part to the first side 207.

In various example embodiments the resiliently-deformable unitary polymer body 200 may further comprise the first diameter 213 being at least twice as large, or three times as large, or four times as large, or more, as the second diameter 223. In various example embodiments the resiliently-deformable unitary polymer body 200 may further comprise the planar cavity 227 being positioned mid-way between the top and bottom sides, 201, 202, respectfully.

Figure 1A:
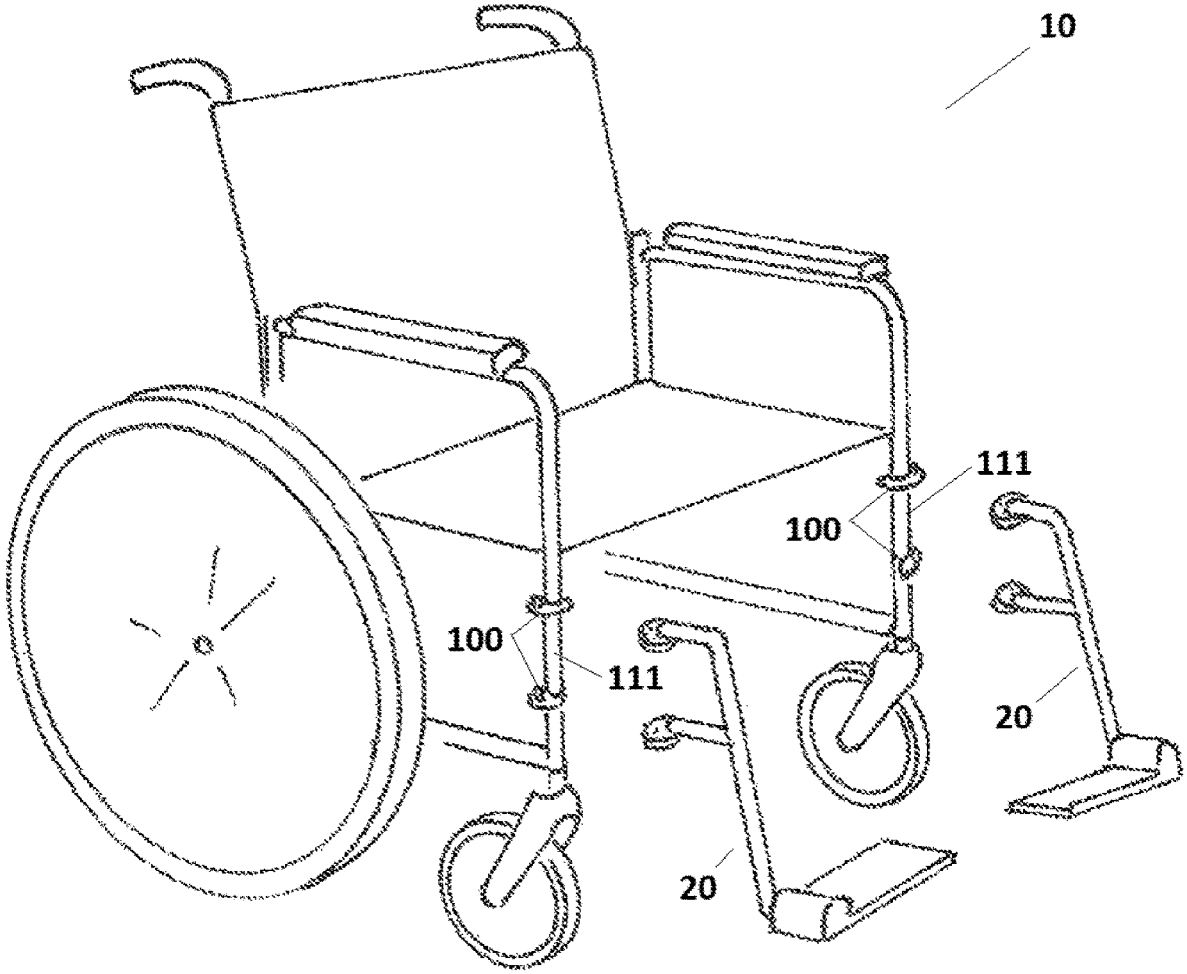
FIG. 1A is a perspective view of a wheelchair having conventional footrest brackets of a type with which the present wheelchair injury-prevention device and method may be used.
Figure 1B:
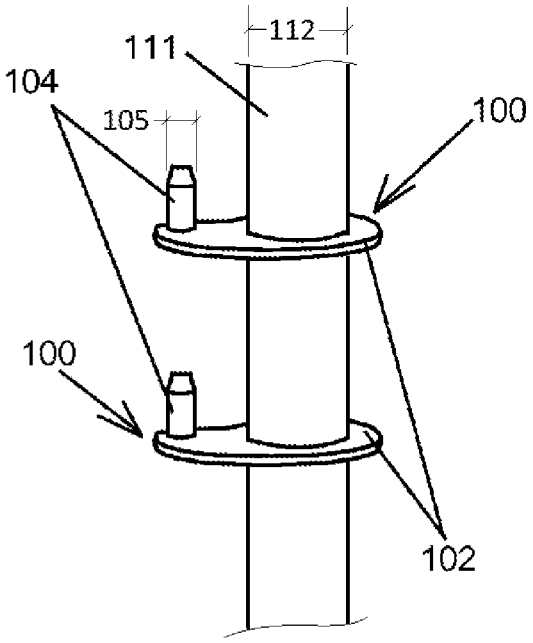

In various example embodiments the resiliently-deformable unitary polymer body 200 may further comprise the first cylindrical portion 212 being sized, shaped, and positioned within the resiliently-deformable unitary polymer body 200 to at least substantially encompass and resiliently urge against a frame tube 111 of a wheelchair 10 on which a bracket 100 for mounting a footrest 20 is mounted, when the resiliently-deformable unitary polymer body 200 is installed on the bracket 100 for mounting a footrest 20 on the wheelchair 10. For example, an inner diameter dimension 213 (FIG. 3) may be selected for first cylindrical portion 212 that is, in its relaxed, undeformed state, smaller than outer diameter dimension 112 of frame tube 111 (FIG. 1B).

In various example embodiments the resiliently-deformable unitary polymer body 200 may further comprise the second cylindrical portion 222 being sized, shaped, and positioned within the resiliently-deformable unitary polymer body 200 to at least substantially encompass and resiliently urge against a post 104 that extends upward from a planar blade 102 of a bracket 100 for mounting a footrest 20 on a wheelchair 10, when the resiliently-deformable unitary polymer body 200 is installed on the bracket 100 for mounting a footrest 20 on the wheelchair 10. For example, an inner diameter dimension 223 (FIG. 3) may be selected for second cylindrical portion 222 that is, in its relaxed, undeformed state, smaller than outer diameter dimension 105 of post 104 (FIG. 1B).

In various example embodiments the resiliently-deformable unitary polymer body 200 may further comprise the planar cavity 227 being sized, shaped, and positioned within the resiliently-deformable unitary polymer body 200 to at least partially encompass and resiliently urge against a planar blade 102 of a bracket 100 for mounting a footrest 20 on a wheelchair 10, when the resiliently-deformable unitary polymer body 200 is installed on the bracket 100 for mounting a footrest 20 on the wheelchair 10. For example, any combination of width, thickness, depth, or outer profile dimensions (FIGS. 2, 4, 5) may be selected for of planar cavity 227 that are, in their relaxed, undeformed state, smaller than one or more corresponding width, thickness, depth, or outer profile dimensions of a planar blade 102 of a bracket 100 (FIG. 1B).

Any combination of one or more of the above features or aspects may be incorporated in a resiliently-deformable unitary polymer body 200 according to various example embodiments. As will be appreciated by persons of skill in the art, the example design of the resiliently-deformable unitary polymer body 200 shown in FIGS. 1-6 is symmetrical about section line A-A (FIG. 4), so that the same design can be used on both the left and right sides of the wheelchair 10 simply by flipping it over, i.e., by inverting the top 201 and bottom 202 sides. Persons of skill in the art will also recognize that the example design of the resiliently-deformable unitary polymer body 200 shown in FIGS. 1-6, when installed, does not necessarily completely surround the planar blade 102 (or the frame tube 111 or the post 104). However, in such cases, the uncovered portions of the planar blade 102 (and the frame tube 111 and the post 104) are those portions facing toward the rear of the wheelchair 10, i.e., those portions not exposed to the legs of a person sitting in the wheelchair 10. This is accomplished by positioning the first side 207 of the resiliently-deformable unitary polymer body 200, i.e., the side featuring the openings 215, 225, and 227, toward the rear of the wheelchair 10, so that the closed second side 208 and the deeply-cushioned front side 204 are positioned toward the front of the wheelchair 10 and exposed to the legs of a person sitting in the wheelchair 10.

It is contemplated that the example design of the resiliently-deformable unitary polymer body 200 shown in FIGS. 1-6 could be changed in certain example embodiments by adding one or more unlockable locking members across one or more of openings 215, 225, and 227 on the first side 207, using a structure such as, for example, the interlocking digits 114 and mating recesses 116 shown in FIGS. 2A and 2B of Hector, Jr., incorporated herein by reference.

With continuing reference to FIGS. 1-6, also provided in various example embodiments is wheelchair 10, comprising: a frame tube 111; a bracket 100 for mounting a footrest 20, the bracket 100 mounted to the frame tube 111, the bracket 100 for mounting a footrest 20 comprising: a planar blade 102 extending perpendicularly from the frame tube 111; a post 104 that extends upward from the planar blade 102; and a resiliently-deformable unitary polymer body 200 as described herein, mounted to the bracket 100 for mounting a footrest 20. Any suitable wheelchair 10 may be used, regardless whether it appears similar to the example wheelchair 10 shown in FIG. 1A. For further information and illustrations regarding mounting wheelchair injury-prevention devices to brackets 100, see Hall et al., Hector, J R., and Lane et al., incorporated herein by reference.

In various example embodiments, a wheelchair 10 may further comprise the resiliently-deformable unitary polymer body 200 being mounted to the bracket 100 for mounting a footrest 20 so that the first cylindrical portion 212 at least substantially encompasses and resiliently urges against the frame tube 111 of the wheelchair 10. For example, an inner diameter dimension 213 (FIG. 3) may be selected for first cylindrical portion 212 that is, in its relaxed, undeformed state, smaller than outer diameter dimension 112 of frame tube 111 (FIG. 1B).

In various example embodiments, a wheelchair 10 may further comprise the resiliently-deformable unitary polymer body 200 being mounted to the bracket 100 for mounting a footrest 20 so that the second cylindrical portion 222 at least substantially encompasses and resiliently urges against the post 104. For example, an inner diameter dimension 223 (FIG. 3) may be selected for second cylindrical portion 222 that is, in its relaxed, undeformed state, smaller than outer diameter dimension 105 of post 104 (FIG. 1B).

In various example embodiments, a wheelchair 10 may further comprise the resiliently-deformable unitary polymer body 200 being mounted to the bracket 100 for mounting a footrest 20 so that the planar cavity 227 at least partially encompasses and resiliently urges against the planar blade 102. For example, any combination of width, thickness, depth, or outer profile dimensions (FIGS. 2, 4, 5) may be selected for of planar cavity 227 that are, in their relaxed, undeformed state, smaller than one or more corresponding width, thickness, depth, or outer profile dimensions of a planar blade 102 of a bracket 100 (FIG. 1B).

Any combination of one or more of the above features or aspects may be incorporated in a wheelchair 10 according to various example embodiments.

With continuing reference to FIGS. 1-6 and Hall et al., Hector, J R., and Lane et al., incorporated herein by reference, provided in various example embodiments is a method of removably installing a resiliently-deformable unitary polymer body 200 on a bracket 100 for mounting a footrest 20 on a wheelchair 10, comprising the steps of providing a wheelchair 10, comprising: a frame tube 111 having a frame tube diameter 112; and a bracket 100 for mounting a footrest 20 mounted to the frame tube 111, wherein the bracket 100 for mounting a footrest 20 comprises a planar blade 102 extending perpendicularly from the frame tube 111; and a post 104 that extends upward from the planar blade 102, the post 104 having a post diameter 105. In various example embodiments the method may further comprise the step of providing a resiliently-deformable unitary polymer body 200 as described herein; and mounting the resiliently-deformable unitary polymer body 200 on the bracket 100 for mounting a footrest 20.

In various example embodiments the step of mounting the resiliently-deformable unitary polymer body 200 on the bracket 100 for mounting a footrest 20 may further comprise the steps of sliding the planar blade 102 at least partially into planar cavity 227 so that the planar cavity 227 at least partially encompasses and resiliently urges against the planar blade 102.

In various example embodiments the step of mounting the resiliently-deformable unitary polymer body 200 on the bracket 100 for mounting a footrest 20 may further comprise the steps of mounting the first cylindrical portion 212 of the resiliently-deformable unitary polymer body 200 to the bracket 100 for mounting a footrest 20 by urging the first slot 214 against the frame tube 111 of the wheelchair 10, temporarily deforming the first opening 215 to have a deformed width (not shown) equal to the frame tube diameter 112, and moving the first cylindrical portion 212 to be adjacent the frame tube 111 of the wheelchair 10, so the first cylindrical portion 212 at least substantially encompasses and resiliently urges against the frame tube 111 of the wheelchair 10.

In various example embodiments the step of mounting the resiliently-deformable unitary polymer body 200 on the bracket 100 for mounting a footrest 20 may further comprise the steps of mounting the second cylindrical portion 222 of the resiliently-deformable unitary polymer body 200 to the bracket 100 for mounting a footrest 20 by urging the second slot 224 against the post 104, temporarily deforming the second opening 225 to have a deformed width (not shown) equal to the post diameter 105, and moving the second cylindrical portion 222 to be adjacent the post 104, so the second cylindrical portion 222 at least substantially encompasses and resiliently urges against the post 104.

In various example embodiments the step of mounting the resiliently-deformable unitary polymer body 200 on the bracket 100 for mounting a footrest 20 may further comprise the steps of sliding the planar blade 102 at least partially into planar cavity 227 so that the planar cavity 227 at least partially encompasses and resiliently urges against the planar blade 102.

Any combination of one or more of the above steps may be performed in a method according to various example embodiments, in any order, including simultaneously.

Any of the suitable technologies, materials, and designs set forth and incorporated herein may be used to implement various example aspects of the invention as would be apparent to one of skill in the art.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A resiliently-deformable unitary polymer body configured to be removably installed on a wheelchair footrest bracket, the body comprising:

top and bottom sides separated by a height;

front and back sides separated by a depth;

first and second sides separated by a width;

a first keyhole-shaped opening comprising a first wall defining a first cylindrical portion having a first diameter and extending from the top side to the bottom side and open to the top side and the bottom side, the first wall also extending to the first side and forming a first slot extending from the top side to the bottom side and defining a first opening from the first side into the first cylindrical portion, the first opening configured to have an undeformed first width less than the first diameter, and configured to be deformable to have a deformed first width at least equal to the first diameter;

a second keyhole-shaped opening spaced-apart from the first keyhole-shaped opening and comprising a second wall defining a second cylindrical portion having a second diameter and extending from the top side to the bottom side and open to the top side and the bottom side, the second wall also extending to the first side and forming a second slot extending from the top side to the bottom side and defining a second opening from the first side into the second cylindrical portion, the second opening configured to have an undeformed second width less than the second diameter, and configured to be deformable to have a deformed second width at least equal to the second diameter;

a planar cavity located between the top and bottom sides, the planar cavity intersecting perpendicularly the first and second keyhole-shaped openings, and open at least in part to the first side.

2. The resiliently-deformable unitary polymer body of claim 1, further comprising the first diameter is at least twice as large as the second diameter.

3. The resiliently-deformable unitary polymer body of claim 1, further comprising the planar cavity is positioned mid-way between the top and bottom sides.

4. The resiliently-deformable unitary polymer body of claim 1, further comprising the first cylindrical portion is sized, shaped, and positioned within the resiliently-deformable unitary polymer body to at least substantially encompass and resiliently urge against a wheelchair frame tube on which a wheelchair footrest bracket is mounted, when the resiliently-deformable unitary polymer body is installed on the wheelchair footrest bracket.

5. The resiliently-deformable unitary polymer body of claim 1, further comprising the second cylindrical portion is sized, shaped, and positioned within the resiliently-deformable unitary polymer body to at least substantially encompass and resiliently urge against a post that extends upward from a planar blade of a wheelchair footrest bracket, when the resiliently-deformable unitary polymer body is installed on the wheelchair footrest bracket.

6. The resiliently-deformable unitary polymer body of claim 1, further comprising the planar cavity is sized, shaped, and positioned within the resiliently-deformable unitary polymer body to at least partially encompass and resiliently urge against a planar blade of a wheelchair footrest bracket, when the resiliently-deformable unitary polymer body is installed on the wheelchair footrest bracket.

7. The resiliently-deformable unitary polymer body of claim 1, further comprising:

the first cylindrical portion is sized, shaped, and positioned within the resiliently-deformable unitary polymer body to at least substantially encompass and resiliently urge against a wheelchair frame tube on which a wheelchair footrest bracket is mounted, when the resiliently-deformable unitary polymer body is installed on the wheelchair footrest bracket; and the second cylindrical portion is sized, shaped, and positioned within the resiliently-deformable unitary polymer body to at least substantially encompass and resiliently urge against a post that extends upward from a planar blade of the wheelchair footrest bracket, when the resiliently-deformable unitary polymer body is installed on the wheelchair footrest bracket.

8. The resiliently-deformable unitary polymer body of claim 7, further comprising:

the planar cavity is sized, shaped, and positioned within the resiliently-deformable unitary polymer body to at least partially encompass and resiliently urge against the planar blade of the wheelchair footrest bracket, when the resiliently-deformable unitary polymer body is installed on the wheelchair footrest bracket.

9. A wheelchair, comprising:

a frame tube;

a footrest bracket mounted to the frame tube, the footrest bracket comprising:

a planar blade extending perpendicularly from the frame tube;

a post that extends upward from the planar blade;

the resiliently-deformable unitary polymer body of claim 1, mounted to the footrest bracket.

10. The wheelchair of claim 9, further comprising:

the resiliently-deformable unitary polymer body is mounted to the footrest bracket so that the first cylindrical portion at least substantially encompasses and resiliently urges against the wheelchair frame tube.

11. The wheelchair of claim 9, further comprising:

the resiliently-deformable unitary polymer body is mounted to the footrest bracket so that the second cylindrical portion at least substantially encompasses and resiliently urges against the post.

12. The wheelchair of claim 9, further comprising:

the resiliently-deformable unitary polymer body is mounted to the footrest bracket so that the planar cavity at least partially encompasses and resiliently urges against the planar blade.

13. The wheelchair of claim 9, further comprising:

the resiliently-deformable unitary polymer body is mounted to the footrest bracket so that the first cylindrical portion at least substantially encompasses and resiliently urges against the wheelchair frame tube, and so that the second cylindrical portion at least substantially encompasses and resiliently urges against the post.

14. The wheelchair of claim 13, further comprising:

the resiliently-deformable unitary polymer body is mounted to the footrest bracket so that the planar cavity at least partially encompasses and resiliently urges against the planar blade.

15. A method of removably installing a resiliently-deformable unitary polymer body on a wheelchair footrest bracket, comprising the steps of:

providing a wheelchair, comprising:

a frame tube having a frame tube diameter;

a footrest bracket mounted to the frame tube, the footrest bracket comprising:

a planar blade extending perpendicularly from the frame tube;

a post that extends upward from the planar blade, the post having a post diameter;

providing the resiliently-deformable unitary polymer body of claim 1;

mounting the resiliently-deformable unitary polymer body on the footrest bracket.

16. The method of claim 15, the step of mounting the resiliently-deformable unitary polymer body on the footrest bracket further comprising the steps of:

sliding the planar blade at least partially into planar cavity so that the planar cavity at least partially encompasses and resiliently urges against the planar blade.

17. The method of claim 15, the step of mounting the resiliently-deformable unitary polymer body on the footrest bracket further comprising the steps of:

mounting the first cylindrical portion of the resiliently-deformable unitary polymer body to the footrest bracket by urging the first slot against the wheelchair frame tube, temporarily deforming the first opening to have a width at least equal to the frame tube diameter, and moving the first cylindrical portion to be adjacent the wheelchair frame tube, so the first cylindrical portion at least substantially encompasses and resiliently urges against the wheelchair frame tube.

18. The method of claim 15, the step of mounting the resiliently-deformable unitary polymer body on the footrest bracket further comprising the steps of:

mounting the second cylindrical portion of the resiliently-deformable unitary polymer body to the footrest bracket by urging the second slot against the post, temporarily deforming the second opening to have a width at least equal to the post diameter, and moving the second cylindrical portion to be adjacent the post, so the second cylindrical portion at least substantially encompasses and resiliently urges against the post.

19. The method of claim 15, the step of mounting the resiliently-deformable unitary polymer body on the footrest bracket further comprising the steps of:

mounting the first cylindrical portion of the resiliently-deformable unitary polymer body to the footrest bracket by urging the first slot against the wheelchair frame tube, temporarily deforming the first opening to have a width at least equal to the frame tube diameter, and moving the first cylindrical portion to be adjacent the wheelchair frame tube, so the first cylindrical portion at least substantially encompasses and resiliently urges against the wheelchair frame tube; and mounting the second cylindrical portion of the resiliently-deformable unitary polymer body to the footrest bracket by urging the second slot against the post, temporarily deforming the second opening to have a width at least equal to the post diameter, and moving the second cylindrical portion to be adjacent the post, so the second cylindrical portion at least substantially encompasses and resiliently urges against the post.

20. The method of claim 15, the step of mounting the resiliently-deformable unitary polymer body on the footrest bracket further comprising the steps of:

sliding the planar blade at least partially into planar cavity so that the planar cavity at least partially encompasses and resiliently urges against the planar blade;

mounting the first cylindrical portion of the resiliently-deformable unitary polymer body to the footrest bracket by urging the first slot against the wheelchair frame tube, temporarily deforming the first opening to have a width at least equal to the frame tube diameter, and moving the first cylindrical portion to be adjacent the wheelchair frame tube, so the first cylindrical portion at least substantially encompasses and resiliently urges against the wheelchair frame tube; and mounting the second cylindrical portion of the resiliently-deformable unitary polymer body to the footrest bracket by urging the second slot against the post, temporarily deforming the second opening to have a width at least equal to the post diameter, and moving the second cylindrical portion to be adjacent the post, so the second cylindrical portion at least substantially encompasses and resiliently urges against the post.

* * * * *